US006514927B2

(12) United States Patent
Lang et al.

(10) Patent No.: US 6,514,927 B2
(45) Date of Patent: Feb. 4, 2003

(54) DETERGENT AND CLEANER CONTAINING SOIL RELEASE POLYMER AND ALKANESULFONATE AND/OR α-OLEFINSULFONATE

(75) Inventors: Frank-Peter Lang, Hattersheim (DE); Gerd Reinhardt, Kelkheim (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/969,463

(22) Filed: Oct. 2, 2001

(65) Prior Publication Data

US 2002/0042354 A1 Apr. 11, 2002

Related U.S. Application Data

(63) Continuation of application No. 09/097,366, filed on Jun. 15, 1998, now abandoned.

(30) Foreign Application Priority Data

Jun. 17, 1997 (DE) ..... 197 25 508

(51) Int. Cl.[7] ..... C11D 17/00

(52) U.S. Cl. ..... 510/357; 510/424; 510/426; 510/428; 510/492; 510/517; 510/528

(58) Field of Search ..... 510/357, 392, 510/276, 492, 424, 426, 428, 517, 528

(56) References Cited

U.S. PATENT DOCUMENTS

| | | | | |
|---|---|---|---|---|
| 1,985,424 A | | 12/1934 | Piggott | 554/66 |
| 2,016,962 A | | 10/1935 | Flint et al. | 536/55.3 |
| 2,703,798 A | | 3/1955 | Schwartz | 554/66 |
| 3,332,880 A | | 7/1967 | Kessler et al. | 510/327 |
| 3,547,828 A | | 12/1970 | Mansfield et al. | 516/72 |
| 3,632,957 A | | 1/1972 | Hannah | 219/119 |
| 3,962,152 A | * | 6/1976 | Nicol et al. | 252/551 |
| 4,116,885 A | | 9/1978 | Derstadt et al. | 510/229 |
| 4,125,370 A | | 11/1978 | Nicol | 8/137.5 |
| 4,264,738 A | | 4/1981 | Stepanov et al. | 435/222 |
| 4,266,031 A | | 5/1981 | Tang et al. | 435/188 |
| 4,287,082 A | | 9/1981 | Tolfo et al. | 510/393 |
| 4,372,868 A | | 2/1983 | Saran et al. | 252/186.38 |
| 4,404,115 A | | 9/1983 | Tai | 510/393 |
| 4,411,831 A | | 10/1983 | Robinson et al. | 252/554 |
| 4,435,307 A | | 3/1984 | Barbesgaard et al. | 510/305 |
| 4,443,355 A | | 4/1984 | Murata et al. | 510/320 |
| 4,462,922 A | | 7/1984 | Boskamp | 510/393 |
| 4,585,642 A | | 4/1986 | Rieck | 423/333 |
| 4,590,237 A | | 5/1986 | Wuhrmann et al. | 524/480 |
| 4,636,468 A | | 1/1987 | Arbige et al. | 435/198 |
| 4,664,839 A | | 5/1987 | Rieck | 252/175 |
| 4,665,029 A | | 5/1987 | Iwai et al. | 435/198 |
| 4,726,954 A | | 2/1988 | Arbige et al. | 426/35 |
| 4,810,414 A | | 3/1989 | Huge-Jensen et al. | 510/320 |
| 4,820,439 A | | 4/1989 | Rieck | 510/469 |
| 4,832,866 A | | 5/1989 | Schulz et al. | 516/120 |
| 4,865,774 A | | 9/1989 | Fabry et al. | 510/428 |
| 4,876,024 A | | 10/1989 | Enomoto et al. | 510/320 |
| 4,904,599 A | | 2/1990 | Ozaki et al. | 435/252.23 |
| 4,933,287 A | | 6/1990 | Farin et al. | 510/392 |
| 4,943,532 A | | 7/1990 | Kawai et al. | 435/209 |
| 4,945,053 A | | 7/1990 | Ito et al. | 435/209 |
| 4,950,417 A | | 8/1990 | Baycroft et al. | 510/320 |
| 4,962,030 A | | 10/1990 | Kawai et al. | 435/209 |
| 5,002,695 A | | 3/1991 | Schulz et al. | 516/131 |
| 5,045,464 A | | 9/1991 | Ito et al. | 435/209 |
| 5,069,809 A | | 12/1991 | Lagerwaard et al. | 510/305 |
| 5,093,256 A | | 3/1992 | Shen et al. | 435/198 |
| 5,100,796 A | | 3/1992 | Paridans et al. | 510/320 |
| 5,108,457 A | | 4/1992 | Poulose et al. | 8/111 |
| 5,138,046 A | | 8/1992 | Wuest et al. | 536/18.6 |
| 5,153,135 A | | 10/1992 | Farin et al. | 435/253.3 |
| 5,166,069 A | | 11/1992 | Shen et al. | 435/252.5 |
| 5,182,043 A | | 1/1993 | Morrall et al. | 252/174 |
| 5,183,651 A | | 2/1993 | Schimmel et al. | 423/334 |
| 5,196,133 A | | 3/1993 | Leslie et al. | 252/95 |
| 5,236,682 A | | 8/1993 | Schimmel et al. | 423/334 |
| 5,240,851 A | | 8/1993 | Paridans et al. | 435/253.3 |
| 5,256,168 A | * | 10/1993 | Morrall et al. | 8/137 |
| 5,268,156 A | | 12/1993 | Schmimmel et al. | 423/334 |
| 5,275,753 A | | 1/1994 | de Buzzaccarini et al. | 510/303 |
| 5,278,066 A | | 1/1994 | Andreoli et al. | 435/252.34 |
| 5,290,694 A | | 3/1994 | Nakanishi et al. | 435/198 |
| 5,308,596 A | | 5/1994 | Kotzian et al. | 423/333 |
| 5,356,607 A | | 10/1994 | Just | 423/334 |
| 5,374,716 A | | 12/1994 | Biermann et al. | 536/18.6 |
| 5,415,807 A | * | 5/1995 | Gosselink et al. | 252/174.21 |
| 5,422,030 A | | 6/1995 | Panandiker et al. | 510/393 |
| 5,427,936 A | | 6/1995 | Moeller et al. | 435/198 |
| 5,529,917 A | | 6/1996 | Andreoli et al. | 435/198 |
| 5,541,316 A | | 7/1996 | Engelskirehen et al. | 510/471 |
| 5,576,425 A | | 11/1996 | Hill et al. | 536/18.6 |
| 5,580,486 A | | 12/1996 | Labeque et al. | 510/321 |
| 5,580,941 A | | 12/1996 | Krause et al. | 527/300 |
| 5,599,782 A | | 2/1997 | Pan et al. | 510/299 |
| 5,789,372 A | | 8/1998 | Fabry | 510/502 |
| 5,880,083 A | | 3/1999 | Beaujean et al. | 510/371 |
| 5,922,663 A | | 7/1999 | Gabriel | 510/299 |

FOREIGN PATENT DOCUMENTS

| | | |
|---|---|---|
| DE | 1617141 | 4/1972 |
| DE | 2253063 | 5/1973 |
| DE | 2200911 | 10/1973 |
| DE | 2857292 | 2/1980 |
| DE | 3324258 | 1/1984 |
| EP | 0066944 | 12/1982 |
| EP | 0185427 | 6/1986 |
| EP | 0241984 | 10/1987 |

(List continued on next page.)

OTHER PUBLICATIONS

Derwent Abstract—EP 375102 (Translation—US 5,108,457) Apr. 1992.

(List continued on next page.)

*Primary Examiner*—Necholus Ogden
(74) *Attorney, Agent, or Firm*—Richard P. Silverman

(57) ABSTRACT

Detergents and cleaners comprising an active ingredient combination of a soil-release polymer and alkanesulfonate and/or α-olefinsulfonate.

4 Claims, No Drawings

FOREIGN PATENT DOCUMENTS

| | | |
|---|---|---|
| EP | 0241985 | 10/1987 |
| EP | 0253567 | 1/1988 |
| EP | 0272033 | 6/1988 |
| EP | 0274907 | 7/1988 |
| EP | 0357280 | 3/1990 |
| GB | 1 382 681 | 2/1975 |
| WO | WO 90/10695 | 9/1990 |
| WO | WO 90/13533 | 11/1990 |
| WO | WO 91/02792 | 3/1991 |
| WO | WO 91/08171 | 6/1991 |
| WO | WO 91/16422 | 10/1991 |
| WO | WO 92/06984 | 4/1992 |
| WO | WO 93/11215 | 6/1993 |
| WO | WO 96/16150 | 5/1996 |

OTHER PUBLICATIONS

Derwent Abstract—EP 378262 (Translation—US Patent 5,275,753) Jan. 1994.
Derwent Abstract—EP 384717 (Translation—US Patents 5,093,256 & 5,166,069) Mar. 1992.
Derwent Abstract—EP 425428 (Translation—US Patent 5,236,682) Aug. 1993.
Derwent Abstract—EP 436835 (Translation—US Patent 5,183,651) Feb. 1993.
Derwent Abstract—EP 468102 (Translation—US Patent 4,950,417) Aug. 1990.
Derwent Abstract—EP 502325 (Translation—US Patent 5,268,156) Dec. 1993.
Derwent Abstract—EP 511456 (Translation—US Patent 5,422,030) Jun. 1995.
Derwent Abstract—EP 548599 (Translation—US Patent 5,308,596) Mar. 1994.
Derwent Abstract—EP 583536 (Translation—US Patent 5,580,486) Dec. 1996.
Derwent Abstract—EP 80223 (Translation—US Patent 4,462,922) Jul. 1984.
Derwent Abstract—EP 80748 (Translation—US Patent 4,404,115) Sep. 1983.
Derwent Abstract—EP 6638 (Translation—US Patent 4,266,031) May 1981.
Derwent Abstract—DE 3117250 (Translation—US Patent 4,435,307) Apr. 1984.
Derwent Abstract—DE 3322950 (Translation—US Patent 4,443,355) Apr. 1984.
Derwent Abstract—DE 4221381 (Translation—US Patent 5,580,941) Dec. 1996.
"Soil–Release Wirkung von Tensiden und Polymeren in moderen Waschmittein," by H.–U. Jäger, J. Huff, BASF Atkiengesellschaft, pp. 27–38 (1996) NMA.
Derwent Abstract—EP 167309 (Translation—US Patents 4,636,468 & 4,726,954) Jan. 1987.
Derwent Abstract—EP 214761 (Translation—US Patent 4,876,024) Oct. 1989.
Derwent Abstract—EP 218272 (Translation—US Patents 4,935,287; 5,153,135 & 5,529,917) Jun. 1990.
Derwent Abstract—EP 258068 (Translation—US Patent 4,810,414) Mar. 1989.
Derwent Abstract—EP 262588 (Translation—US Patent 4,832,866) May 1989.
Derwent Abstact—EP 265832 (Translation—US Patent 4,945,053) Jul. 1990.
Derwent Abstract—EP 269977 (Translation—US Patent 4,962,030) Oct. 1990.
Derwent Abstract—EP 270974 (Translation—US Patent 4,943,532) Jul. 1990.
Derwent Abstract—273125 (Translation—US Patent 4,904,599) Feb. 1990.
Derwent Abstract—EP 28865 (Translation—US Patent 4,287,082) Sep. 1981.
Derwent Abstract—EP 301298 (Translation—US Patent 5,374,716) Dec. 1994.
Derwent Abstract—EP 301414 (Translation—US Patent 4,865,774) Sep. 1989.
Derwent Abstract—EP 309931 (Translation—US Patent 5,002,695) Mar. 1991.
Derwent Abstract—EP 331376 (Translation—US Patent 5,290,694) Mar. 1994.
Derwent Abstract—EP 330641 (Translation—US Patents 5,100,796 & 5,240,851) Mar. 1992.
Derwent Abstract—EP 339550 (Translation—US Patent 5,045,464) Sep. 1991.
Derwent Abstract—EP 341947 (Translation—US Patent 5,069,809) Dec. 1991.
Derwent Abstract—EP 334462 (Translation—US Patents 5,278,066 & 5,529,917) Jan. 1994.
Derwent Abstract—EP 357969 (Translation—US Patent 5,138,046) Aug. 1992.
Derwent Abstract—EP 362671 (Translation—US Patent 5,576,425) Nov. 1996.
Derwent Abstract—EP 37026 (Translation—US Patent 4,372,868) Feb. 1983.
Derwent Abstract—DE 3436194 NMA.
Derwent Abstract DE 4300772 NMA.
Derwent Abstract—JP 04238809 NMA.
Derwent Abstract—JP 04260610 NMA.
Derwent Abstract—WO 9316110 (Translation—US Patent 5,541,316) Jul. 1996.
Derwent Abstract—EP 117553 (Translation—US Patent 4,665,029) May 1987.
Derwent Abstract—EP 150386 (Translation—US Patent 4,590,237) May 1986.
Derwent Abstract—EP 164514 (Translation—US Patents 4,664,839 & 4,820,439) May 1987.
Derwent Abstract—EP 164552 (Translation—US Patent 4,585,642) Apr. 1986.
Derwent Abstract—DE 2121397 NMA.
Derwent Abstract—DE 2412837 NMA.
Derwent Abstract—DD 255884 NMA.
Derwent Abstract—DE 3207825 NMA.
Derwent Abstract—DE 3207847 NMA.
Derwent Abstract—EP 385401 NMA.
Derwent Abstract—EP 451921 NMA.
Derwent Abstract—EP 92355 NMA.
Derwent Abstract—DE 1940488 NMA.
Derwent Abstract—DE 2044161 NMA.
Derwent Abstract—EP 305216 NMA.
Derwent Abstract—EP 376705 NMA.
Derwent Abstract—EP 378261 NMA.
Derwent Abstract—EP 130064 NMA.
Derwent Abstract—EP 204284 NMA.
Derwent Abstract—EP 294753 NMA.

* cited by examiner

DETERGENT AND CLEANER CONTAINING SOIL RELEASE POLYMER AND ALKANESULFONATE AND/OR α-OLEFINSULFONATE

CROSS-REFERENCE TO RELATED APPLICATIONS

This application claims the benefit of German patent application 19725508.6, filed Jun. 17, 1997, and is a continuation of U.S. patent application Ser. No. 09/097,366, filed Jun. 15, 1998 now abandoned.

FIELD OF THE INVENTION

The invention relates to detergents and cleaners which comprise a soil- release polymer and alkanesulfonate and/or olefinsulfonate as anionic surfactant.

BACKGROUND OF THE INVENTION

In addition to ingredients which are essential for the washing process, such as surfactants and builder materials, detergents usually comprise further constituents which can be grouped under the term washing auxiliaries and which include such differing active ingredient groups as foam regulators, antiredeposition agents, bleaches, bleach activators and color transfer inhibitors. Such auxiliaries also include substances which impart soil-repellent properties to the laundry fiber and which, if present during the washing process, assist the soil-release of the other detergent constituents. By analogy, the same is true of cleaners for hard surfaces. Such soil-release substances are often referred to as soil-repellents in view of their ability to give the treated surface, for example fabric, a soil-repellent finish. Because of their chemical similarity to polyester fibers, particularly effective soil-release active ingredients which are, however, also able to display the desired effect in the case of fabrics made from other material, are copolyesters, which contain dicarboxylic acid units, alkylene glycol units and polyalkylene glycol units. Soil-release copolyesters of said type and also their use in detergents have been known for a long time.

It is also known to increase the cleaning performance of such soil-release polymers through a combination with a surfactant combination of ether sulfate and alkyloligoethoxylates (WO 96/16150).

SUMMARY OF THE INVENTION

We have now found that the cleaning performance of these soil-release polymers can also be increased by the addition of a sec-alkanesulfonate and/or α-olefinsulfonate.

The invention provides a detergent and cleaner which comprises a combination of a soil-release polymer and an alkanesulfonate and/or α-olefinsulfonate.

DETAILED DESCRIPTION OF THE INVENTION

According to the invention, soil-release polymers having molar masses in the range from 600 to 100,000 g/mol and softening temperatures or melting points in the range from 30° C. to 170° C., preferably in the range from 40° C. to 80° C., are advantageous.

Soil-release polymers are, in particular, oligoesters obtainable from, preferably, terephthalic acid, isophthalic acid, sulfoisophthalic acid and/or the methyl esters thereof, aliphatic dicarboxylic acids (saturated and/or unsaturated), for example adipic acid, and/or anhydrides thereof, aliphatic substituted dicarboxylic acids, for example nonylsuccinic acid, alkylene glycols (ethylene glycol, 1,2-propylene glycol and 1,2-butylene glycol), polyethylene glycols, alkyl polyethylene glycols, polyethylene glycol benzoate, polyethylene glycol sulfobenzoate and in some instances alkanolamines.

Suitable soil-release polymers are already sufficiently known from the prior art.

Thus, for example, German Specification DE-A-16 17 141 describes a washing process using polyethylene terephthalate-polyoxyethylene glycol copolymers. German Specification DE-A-22 00 911 relates to detergents which comprise niosurfactant and a mixed polymer of polyoxyethylene glycol and polyethylene terephthalate. German Specification DE-A-22 53 063 mentions acidic textile finishing agents which comprise a copolymer of a dibasic carboxylic acid and an alkylene polyglycol or cycloalkylene polyglycol and optionally an alkylene glycol or cycloalkylene glycol.

Polymers having molecular weights of from 15,000 to 50,000 of ethylene terephthalate and polyethylene oxide terephthalate, in which the polyethylene glycol units have molecular weights from 1000 to 10,000 and the molar ratio of ethylene terephthalate to polyethylene oxide terephthalate is from 2:1 to 6:1, can, according to German Specification DE-A-33 24 258, be used in detergents.

European Patent EP 066 944 relates to textile treatment agents which comprise a copolyester of ethylene glycol, polyethylene glycol, aromatic dicarboxylic acid and sulfonated aromatic dicarboxylic acid in specific molar ratios. European Patent EP 185 427 discloses methyl or ethyl terminally-capped polyesters containing ethylene terephthalate and/or propylene terephthalate units and polyethylene oxide terephthalate units and detergents comprising a soil-release polymer of this type. European Patent EP 241 984 relates to a polyester which, in addition to oxethylene groups and terephthalic acid units, also comprises substituted ethylene units and glycerol units. European Patent EP 241 985 discloses polyesters which, in addition to oxethylene groups and terephthalic acid units, comprise 1,2-propylene, 1,2-butylene and/or 3-methoxy-1,2-propylene groups and glycerol units and are terminally capped with $C_1$–$C_4$-alkyl groups. European Patent EP 253 567 relates to soil-release polymers having a molar mass of from 900 to 9000 of ethylene terephthalate and polyethylene oxide terephthalate, in which the polyethylene glycol units have molecular weights from 300 to 3000 and the molar ratio of ethylene terephthalate to polyethylene oxide terephthalate is from 0.6 to 0.95. European Patent Application EP 272 033 discloses polyesters, at least partially terminally-capped by $C_1$–$C_4$-alkyl or acyl radicals, containing polypropylene terephthalate and polyoxyethylene terephthalate units. European Patent EP 274 907 describes sulfoethyl terminally-capped terephthalate-containing soil-release polyesters. In European Patent Application EP 357 280, soil-release polyesters containing terephthalate, alkylene glycol and poly-$C_2$–$C_4$-glycol units are prepared by sulfonation of unsaturated end groups.

Polymers of ethylene terephthalate and polyethylene oxide terephthalate, in which the polyethylene glycol units have molecular weights of from 750 to 5000 and the molar ratio of ethylene terephthalate to polyethylene oxide terephthalate is from 50:50 to 90:10, and their use in detergents is described in German Patent DE 28 57 292.

Soil-release polyesters of this type are available commercially under the names Sokalan® HP 40, Sokalan 9976 (BASF) or Velvetol® (Rhône-Poulenc), Repel-O-Tex®

(Rhône-Poulenc), Zelcon® (Dupont), Permalose® (ICI) or Milease® (ICI).

Preferred soil-release polyesters include those compounds which are obtainable formally by esterification of two monomer fractions, the first monomer being a dicarboxylic acid HOOC-Ph-COOH and the second monomer being a diol HO—$(CHR^3—)_a$OH, which can also be in the form of a polymeric diol H—(O—$(CHR^3—)_a)_b$OH. Ph is an o-, m- or p-phenylene radical which can carry from 1 to 4 alkyl radicals having from 1 to 22 carbon atoms, sulfonic acid groups, carboxyl groups and mixtures thereof, $R^3$ is hydrogen, an alkyl radical having from 1 to 22 carbon atoms and mixtures thereof, a is a number from 2 to 6 and b is a number from 1 to 300. The polyesters which can be prepared therefrom preferably contain both monomer diol units —O—$(CHR^3—)_a$O— and polymer diol units —(O—$(CHR^3)_a)_b$O—. The molar ratio of monomer diol units to polymer diol units is preferably from 100:1 to 1:100, in particular from 10:1 to 1:10. The degree of polymerization b in the polymer diol units is preferably in the range from 1 to 500, in particular from 12 to 140. The molecular weight or the mean molecular weight or the maximum for the molecular weight distribution of preferred soil-release polyesters is preferably in the range from 250 to 100,000, in particular from 500 to 50,000. The parent acid of the radical Ph is preferably chosen from terephthalic acid, isophthalic acid, phthalic acid, trimellitic acid, mellitic acid, the isomers of sulfophthalic acid, sulfoisophthalic acid and sulfoterephthalic acid and mixtures thereof. If their acid groups are not part of the ester bonds in the polymer, they are preferably present in salt form, in particular as alkali metal salt or ammonium salt. Of these, sodium and potassium salts are particularly preferred. If desired, instead of the monomer HOOC-Ph-COOH, small amounts, in particular no more than 10 mol %, based on the amount of Ph as defined above, of other acids which have at least two carboxyl groups may be present in the soil-release polyester. These include, for example, alkylene- and alkenylenedicarboxylic acids, such as malonic acid, succinic acid, fumaric acid, maleic acid, glutaric acid, adipic acid, pimelic acid, suberic acid, azelaic acid and sebacic acid. Preferred diols HO—$(CHR^3—)_a$OH include those in which $R^3$ is hydrogen and a is a number from 2 to 6, and those in which a is 2 and $R^3$ is hydrogen or alkyl having from 1 to 10, in particular from 1 to 3 carbon atoms. Of the latter diols, those of the formula HO—$CH_2$—$CHR^3$—OH, in which $R^3$ is as defined above are particularly preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. Of the polymeric diols, polyethylene glycol having a mean molar mass in the range from 1000 to 6000 is particularly preferred.

If desired, it is also possible for the polyesters having the above composition to be terminally capped, in which case suitable end groups are alkyl groups having from 1 to 22 carbon atoms and esters of monocarboxylic acids. The end groups bonded via ester bonds may be based on alkyl-, alkenyl- and arylmonocarboxylic acids having from 5 to 32 carbon atoms, in particular from 5 to 18 carbon atoms. These include valeric acid, caproic acid, oenanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, oleic acid, linoleic acid, linolaidic acid, linolenic acid, elaeostearic acid, arachidic acid, gadoleic acid, arachidonic acid, behenic acid, erucic acid, brassidic acid, clupanodonic acid, lignoceric acid, cerotic acid, melissic acid, benzoic acid, which may carry from 1 to 5 substituents having a total of up to 25 carbon atoms, in particular from 1 to 12 carbon atoms, for example tert-butylbenzoic acid. The end groups may also be based on hydroxymonocarboxylic acids having from 5 to 22 carbon atoms, which include, for example, hydroxyvaleric acid, hydroxycaproic acid, ricinoleic acid, its hydrogenation product hydroxystearic acid and o-, m- and p-hydroxybenzoic acid. The hydroxymonocarboxylic acids may for their part be joined together via their hydroxyl group and their carboxyl group and can thus be present in multiples in an end group. The number of hydroxymonocarboxylic acid. units per end group, i.e. its degree of oligomerization, is preferably in the range from 1 to 50, in particular from 1 to 10.

In a preferred embodiment of the invention, the detergent or cleaner comprises polymers of ethylene terephthalate and polyethylene oxide terephthalate in which the polyethylene glycol units have molecular weights of from 750 to 5000 and the molar ratio of ethylene terephthalate to polyethylene oxide terephthalate is from 50:50 to 90:10.

Very particular preference is given to the oligoesters of the formula

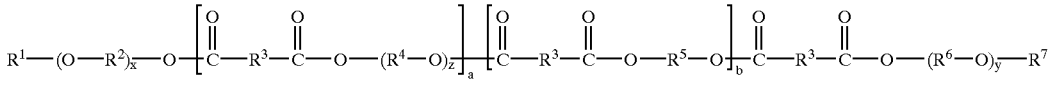

in which $R^1$ and $R^7$ are a linear or branched $C_1$–$C_{18}$-alkyl, $R^2$ and $R^6$ are ethylene, $R^3$ is 1,4-phenylene, $R^4$ is ethylene, $R^5$ is ethylene, 1,2-propylene or random mixtures of any desired composition of the two, x and y independently of one another are numbers between 1 and 500, z is a number between 10 and 140, a is a number between 1 and 12, and b is a number between 7 and 40, where a+b is at least 11.

In preferred meanings, independently of one another $R^1$ and $R^7$ are linear or branched $C_1$–$C_4$-alkyl, x and y are numbers between 3 and 45, z is a number between 18 and 70, a is a number between 2 and 5, b is a number between 8 and 12, and a+b is a number between 12 and 18 or between 25 and 35.

These oligoesters are obtained from dimethyl terephthalate, ethylene glycol and/or propylene glycol, polyethylene glycol and $C_1$–$C_{18}$-alkylpolyethylene glycol using a catalyst firstly by transesterification at temperatures of from 160 to about 220° C. and removal of the methanol by distillation at atmospheric pressure and subsequent removal of the excess glycols by distillation at temperatures of from 160 to about 240° C.

In addition to such soil-release polymers, the novel detergent and cleaner also comprises one or more alkanesulfonates and/or α-olefinsulfonates.

The alkyl group of the alkanesulfonates can either be saturated or unsaturated, branched or linear and optionally substituted by a hydroxyl group. The sulfo group is preferably bonded to a secondary carbon atom but can also be bonded terminally to a primary carbon atom. The alkanesulfonate can be a primary or secondary alkanesulfonate or mixtures thereof. Sec-alkanesulfonates are preferred.

The preferred alkanesulfonates contain linear alkyl chains having from about 9 to 25 carbon atoms, preferably from about 10 to about 22 carbon atoms and particularly preferably from about 13 to 17 or from 16 to 18 carbon atoms. The cation is, for example, sodium, potassium, ammonium, mono-, di- or triethanolammonium, calcium or magnesium and mixtures thereof. Preference is given to secondary alkanesulfonates with sodium as the cation.

The α-olefinsulfonates are obtained by sulfonation of $C_{12}$–$C_{24}$-alpha-olefins, preferably $C_{14}$–$C_{16}$-alpha-olefins with sulfur trioxide and subsequent neutralization. As a consequence of the preparation process, it is possible that these olefinsulfonates comprise relatively small amounts of hydroxyalkanesulfonates and alkanedisulfonates. Specific mixtures of alpha-olefinsulfonates are described in U.S. Pat. No. 3,332,880.

In the active ingredient combination which forms the basis of the invention, the weight ratio of soil-release polyester to the total amount of surfactants is preferably from 1:25 to 1:2, in particular from 1:20 to 1:3.5.

Detergents or cleaners which comprise the active ingredient combination according to the invention may comprise all other customary constituents of such products. The active ingredient combination according to the invention is preferably incorporated into the detergent or cleaner in amounts of from 5% by weight to 50% by weight, in particular from 8% by weight to 25% by weight.

In a preferred embodiment the novel detergents and cleaners comprise not only the surfactants introduced with the active ingredient combination according to the invention but also other nonionic and/or anionic surfactant.

Suitable nonionic surfactants include the alkoxylates, in particular the ethoxylates and/or propoxylates of natural or synthetic, saturated or mono- to polyunsaturated linear or branch-chain alcohols which carry a primary or secondary OH group, having from 10 to 22 carbon atoms, preferably from 12 to 18 carbon atoms. The degree of alkoxylation in the alcohols is usually between 1 and 15, preferably between 3 and 10. They can be prepared in a known manner by reaction of the corresponding alcohols with the corresponding alkylene oxides. It is possible to use, for example, the alkoxylates, in particular the ethoxylates, of primary alcohols containing linear, in particular dodecyl, tetradecyl, hexadecyl or octadecyl radicals and mixtures thereof. In addition, from 1- to 20-fold, in particular 3- to 10-fold, alkoxylation products of alkylamines, vicinal diols and carboxamides, which correspond to said alcohols as regards the alkyl moiety, can be used. Furthermore, the ethylene oxide and/or propylene oxide insertion products of fatty acid alkyl esters, as can be prepared according to the process given in the International Patent Application WO 90/13533, and fatty acid polyhydroxyamides, as can be prepared, for example, according to the processes of U.S. Pat. Nos. 1,985,424, 2,016,962 and 2,703,798 and International Patent Application WO 92/06984, are suitable. Alkyl polyglycosides suitable for incorporation into the products according to the invention are compounds of the formula $(G)p\text{-}OR^4$, in which $R^4$ is an alkyl or alkenyl radical having from 8 to 22 carbon atoms, G is a glycose unit and p is a number between 1 and 10. Such compounds and their preparation are described, for example, in European Patent Application EP 92 355, EP 301 298, EP 357 969 and EP 362 671 or U.S. Pat. No. 3,547,828. The glycoside component $(G)_p$ is an oligomer or polymer of naturally occurring aldose or ketose monomers, which include, in particular, glucose, mannose, fructose, galactose, talose, gulose, altrose, allose, idose, ribose, arabinose, xylose and lyxose. The oligomers which consist of such monomers joined glycosidally are characterized both by the type of sugar present therein and by its number, the degree of oligomerization. The degree of oligomerization p is a value which is determined analytically and generally assumes fractional values; it is between 1 and 10, in the case of the preferred glycosides below 1.5, in particular between 1.2 and 1.4. A preferred monomer unit is glucose because it is readily available. The alkyl or alkenyl moiety R4 in the glycosides likewise preferably originates from readily accessible derivatives of renewable raw materials, in particular from fatty alcohols, although their branch-chain isomers, in particular oxo alcohols, can also be used to prepare utilizable glycosides. Accordingly, it is possible to use, in particular, the primary alcohols having linear octyl, decyl, dodecyl, tetradecyl, hexadecyl or octadecyl radicals and mixtures thereof. Particularly preferred alkyl glycosides contain a coconut fatty alkyl radical, i.e. mixtures where essentially $R^4$=dodecyl and $R^4$=tetradecyl.

An additional nonionic surfactant is present in products which comprise the active ingredient combination which forms the basis of the invention, preferably in amounts of up to 30% by weight, in particular from 1% by weight to 25% by weight, in each case based on the total product.

Products according to the invention may comprise, instead of or as well as other surfactants, preferably synthetic anionic surfactants of the sulfate or sulfonate type, in amounts of preferably no more than 20% by weight, in particular of from 0.1% by weight to 18% by weight, in each case based on the total product. Synthetic anionic surfactants which are particularly suitable for use in such products and which may be mentioned are the alkylsulfates and/or alkenylsulfates having from 8 to 22 carbon atoms which carry an alkali metal, ammonium or alkyl or hydroxyalkyl-substituted ammonium ion as countercation. Preference is given to the sulfated derivatives of fatty alcohols having in particular from 12 to 18 carbon atoms and their branch-chain analogues, the oxo alcohols. The alkylsulfates and alkenylsulfates can be prepared in a known manner by reaction of the corresponding alcohol component with a customary sulfating reagent, in particular sulfur trioxide or chlorosulfuric acid, and subsequent neutralization with ammonium bases having alkali metal, ammonium or alkyl or hydroxyalkyl substituents. Such alkylsulfates and/or alkenylsulfates are preferably present in amounts of from 0.1% by weight to 20% by weight, in particular from 0.5% by weight to 18% by weight. Suitable anionic surfactants of the sulfonate type include the α-sulfoesters obtainable by reaction of fatty acid esters with sulfur trioxide and subsequent neutralization, in particular the sulfonation products derived from fatty acids having from 8 to 22 carbon atoms, preferably from 12 to 18 carbon atoms, and linear alcohols having from 1 to 6 carbon atoms, preferably from 1 to 4 carbon atoms, and the sulfofatty acids produced therefrom by formal hydrolysis.

Other suitable anionic surfactants are alkenyl- or alkylbenzenesulfonates. The alkenyl or alkyl group can be branched or linear and is optionally substituted by a hydroxyl group. The preferred alkylbenzenesulfonates contain linear alkyl chains having from about 9 to 25 carbon atoms, preferably from about 10 to about 13 carbon atoms; the cation is sodium, potassium, ammonium, mono-, di- or triethanolammonium, calcium or magnesium and mixtures thereof.

Suitable anionic surfactants of the sulfate type are also alkyl ether sulfates. These are water-soluble salts or acids of the formula $RO(A)_mSO_3M$, in which R is an unsubstituted $C_{10}$–$C_{24}$-alkyl or -hydroxyalkyl radical, preferably a $C_{12}$–$C_{20}$-alkyl or -hydroxyalkyl radical, particularly preferably a $C_{12}$–$C_{18}$-alkyl or -hydroxyalkyl radical. A is an ethoxy or propoxy unit, m is a number greater than 0, preferably between about 0.5 and about 6, particularly preferably between about 1.5 and about 3 and M is a hydrogen atom or a cation, such as, for example, sodium, potassium, lithium, calcium, magnesium, ammonium or a substituted ammonium cation. Specific examples of substituted ammonium cations are methyl-, dimethyl-, trimethylammonium and quaternary ammonium cations, such as tetramethylammonium and dimethylpiperidinium cations, and those which are derived from alkylamines, such as ethylamine, diethylamine, triethylamine and mixtures thereof. Examples which may be mentioned are $C_{12}$–$C_{18}$-fatty alcohol ether sulfates, the content of ethylene oxide being 1, 2, 2.5, 3 or 4 mol per mole of fatty alcohol ether sulfate, and in which M is sodium or potassium.

Other suitable and possible surface-active ingredients are soaps, saturated fatty acid soaps, such as the salts of lauric acid, myristic acid, palmitic acid or stearic acid, and soaps derived from natural fatty acid mixtures, for example coconut, palm kernel or tallow fatty acids, being suitable. Particularly preferred soap mixtures are those composed of from 50% by weight to 100% by weight of saturated $C_{12}$–$C_{18}$-fatty acid soaps and up to 50% by weight of oleic acid soaps. Preferably, soap in amounts of from 0.1% by weight to 5% by weight are present. Particularly in liquid products according to the invention, it is however also possible for greater amounts of soap of as a rule up to 20% by weight to be present.

In another embodiment, a product according to the invention comprises water-soluble and/or water-insoluble builders in particular chosen from alkali metal alumosilicate, crystalline alkali metal silicate having a modulus above 1, monomeric polycarboxylate, polymeric polycarboxylate and mixtures thereof, in particular in amounts in the range from 2.5% by weight to 60% by weight.

A product which comprises the active substance combination which forms the basis of the invention preferably comprises from 20% by weight to 55% by weight of water-soluble and/or water-insoluble organic and/or inorganic builders. The water-soluble organic builder substances include, in particular, those from the class of polycarboxylic acids, in particular citric acid and sugar acids, and the polymeric (poly)carboxylic acids, in particular the polycarboxylates obtainable by oxidation of polysaccharides as in International Patent Application WO 93/161 10, polymeric acrylic acids, methacrylic acids, maleic acids and mixed polymers thereof, which may also comprise small amounts of polymerizable substances without carboxylic acid functionality incorporated by polymerization. The relative molecular mass of the homopolymers of unsaturated carboxylic acids is generally between 5000 and 200,000, that of the copolymers is between 2000 and 200,000, preferably between 50,000 and 120,000, based on free acid. A particularly preferred acrylic acid-maleic acid copolymer has a relative molecular mass of from 50,000 to 100,000. Suitable, if less preferred, compounds of this class are copolymers of acrylic acid or methacrylic acid with vinyl ethers, such as vinyl methyl ethers, vinyl esters, ethylene, propylene and styrene, in which the proportion of the acid is at least 50% by weight. Water-soluble organic builder substances which may be used are also terpolymers which comprise, as monomers, two unsaturated acids and/or salts thereof and, as a third monomer, vinyl alcohol and/or a vinyl alcohol derivative or a carbohydrate. The first acidic monomer or the salt thereof is derived from a monoethylenically unsaturated $C_3$–$C_8$-carboxylic acid and preferably from a $C_3$–$C_4$-monocarboxylic acid, in particular from (meth)acrylic acid. The second acidic monomer or the salt thereof can be a derivative of a $C_4$–$C_8$-dicarboxylic acid, preferably of a $C_4$–$C_8$-dicarboxylic acid, maleic acid being particularly preferred. The third monomeric unit is in this case formed from vinyl alcohol and/or preferably an esterified vinyl alcohol. In particular, vinyl alcohol derivatives which are esters of short-chain carboxylic acids, for example of $C_1$–$C_4$-carboxylic acids, with vinyl alcohol are preferred. Preferred terpolymers comprise from 60% by weight to 95% by weight, in particular from 70% by weight to 90% by weight of (meth)acrylic acid or (meth)acrylate, particularly preferably acrylic acid or acrylate, and maleic acid or maleate and from 5% by weight to 40% by weight, preferably from 10% by weight to 30% by weight of vinyl alcohol and/or vinyl acetate. In this connection, very particular preference is given to terpolymers in which the weight ratio of (meth)acrylic acid or (meth)acrylate to maleic acid or maleate is between 1:1 and 4:1, preferably between 2:1 and 3:1 and in particular between 2:1 and 2.5:1. Both the amounts and the weight ratios refer to the acids. The second acidic monomer or the salt thereof can also be a derivative of an allylsulfonic acid which is substituted in the 2-position by an alkyl radical, preferably by a $C_1$–$C_4$-alkyl radical, or an aromatic radical which is preferably derived from benzene or benzene derivatives. Preferred terpolymers comprise from 40% by weight to 60% by weight, in particular from 45 to 55% by weight of (meth)acrylic acid or (meth)acrylate, particularly preferably acrylic acid or acrylate, from 10% by weight to 30% by weight, preferably from 15% by weight to 25% by weight, of methallylsulfonic acid or methallylsulfonate and, as third monomer, from 15% by weight to 40% by weight, preferably from 20% by weight to 40% by weight, of a carbohydrate. This carbohydrate can be, for example, a mono-, di-, oligo- or polysaccharide, mono-, di- or oligosaccharides being preferred and sucrose being particularly preferred. Insertion of the third monomer presumably incorporates desired breaking points in the polymer, which are responsible for the good biodegradability of the polymer. These terpolymers can be prepared, in particular, by processes which are described in German Patent DE 42 21 381 and German Patent Application DE 43 00 772, and generally have a relative molecular mass between 1000 and 200,000, preferably between 200 and 50,000 and in particular between 3000 and 10,000. They can be used, particularly for the preparation of liquid products, in the form of aqueous solutions, preferably in the form of from 30 percent by weight to 50 percent by weight aqueous solutions. All of the polycarboxylic acids mentioned are usually used in the form of their water-soluble salts, in particular their alkali metal salts.

Organic builder substances of this type are preferably present in amounts up to 40% by weight, in particular up to 25% by weight and particularly preferably from 1% by weight to 5% by weight. Amounts close to the stated upper limit are preferentially used in paste or liquid, in particular aqueous, products which comprise the active ingredient combination which forms the basis of the invention.

Water-insoluble, water-dispersible inorganic builder materials which are used are, in particular, crystalline or amorphous alkali metal alumosilicates, in amounts of up to 50% by weight, preferably no more than 40% by weight and in liquid products, in particular from 1% by weight to 5% by weight. Of these, the crystalline alumosilicates of detergent quality, in particular zeolite A, zeolite P and in some instances zeolite X, are preferred.

Quantities close to the stated upper limit are preferably used in solid, particulate products. In particular, suitable alumosilicates do not have any particles greater than 30 $\mu$m in size and preferably consist of at least 80% by weight of particles less than 10 $\mu$m in size. Its calcium-binding ability, which can be determined according to the details in German Patent DE 24 12 837, is usually in the range from 100 to 200 mg of CaO per gram. Suitable substitutes or partial substitutes for said alumosilicate are crystalline or amorphous alkali metal silicates which can be present alone or mixed with one another. The alkali metal silicates which can be used as backbone substances in the products according to the invention preferably have a molar ratio of alkali metal oxide to $SiO_2$ of less than 0.95, in particular of 1:1.1 to 1:12 and can be amorphous or crystalline. Preferred alkali metal silicates are the sodium silicates, in particular the amorphous sodium silicates, having a molar ratio of $Na_2O:SiO_2$ of from 1:2 to 1:2.8. Amorphous silicates having a molar ratio of from 1:2 to 1:2.11 are obtainable in powder form under the name 3Na and in granulated form under 3NaG from Société Francaise Hoechst. For purposes of detergent preparation, they are preferably added as solid, not as solution. Crystalline silicates which are used are preferably crystalline phyllosilicates of the formula $Na_2Si_xO_{2x+1}yH_2O$, in which x, the modulus, is a number from 1.9 to 4 and y is a number from 0 to 20 and preferred values of x are 2, 3 or 4. Crystalline phyllosilicates which fall under this formula are described, for example, in European Patent Application EP 0 164 514. A crystalline phyllosilicate of this type is available commercially from Hoechst AG under the name SKS-6. Preferred crystalline phyllosilicates are those in which x in the stated formula assumes the value 2 or 3. In particular, both β- and 6-sodium disilicates ($Na_2Si_2O_5yH_2O$) are preferred, β-sodium disilicate being obtainable, for example, by the process which is described in International Patent Application WO 91/08171 . 6-Sodium silicates having a modulus between 1.9 and 3.2 can be prepared according to Japanese Patent Application JP 04/238 809 or JP 04/260 610. Crystalline alkali metal silicates of the above formula in which x is a number from 1.9 to 2.1, which are virtually anhydrous and prepared from amorphous alkali metal silicates as in European Patent Applications EP 0 548 599, EP 0 502 325 and EP 0 425 428, can also be used in products according to the invention. In a further preferred version of products according to the invention, a crystalline sodium phyllosilicate having a modulus of from 2 to 3 is used, as can be prepared from sand and soda according to the process of European Patent Application EP 0 436 835. Crystalline sodium silicates having a modulus in the range from 1.9 to 3.5, as are obtainable by the processes of European Patents EP 0 164 552 and/or EP 0 294 753, are used in a further preferred variant of detergents or cleaners according to the invention. Their content of alkali metal silicates which can be used as builders is preferably from 1% by weight to 50% by weight and in particular from 5% by weight to 35% by weight, based on anhydrous active substance. If alkali metal alumosilicate, in particular zeolite, is present as additional builder substance, the content of alkali metal silicate is preferably from 1% by weight to 15% by weight and in particular from 2% by weight to 8% by weight, based on anhydrous active substance. The weight ratio of alumosilicate to silicate, in each case based on anhydrous active substances, is then preferably from 4:1 to 10:1. In products which comprise both amorphous and crystalline alkali metal silicates, the weight ratio of amorphous alkali metal silicate to crystalline alkali metal silicate is preferably from 1:2 to 2:1 and in particular from 1:1 to 2:1.

As well as said inorganic builders, further water-soluble or water-insoluble inorganic substances may be used in the novel products. In this connection, suitable substances are the alkali metal carbonates, alkali metal hydrogencarbonates and alkali metal sulfates and mixtures thereof. Such additional inorganic material may be present in amounts of up to 70% by weight, but is preferably not present at all.

In addition, the products may comprise further constituents which are customary in detergents and cleaners. These possible constituents include, in particular, enzymes, enzyme stabilizers, bleaches, bleach activators, complexing agents for heavy metals, for example aminopolycarboxylic acids, aminohydroxypolycarboxylic acids, polyphosphonic acids and/or aminopolyphosphonic acids, antiredeposition agents, for example cellulose ethers, color transfer inhibitors, for example polyvinylpyrrolidone or polyvinylpyridine N-oxide, foam inhibitors, for example organopolysiloxanes or paraffins, solvents and optical brighteners, for example stilbenedisulfonic acid derivatives. The novel products preferably comprise up to 1% by weight, in particular from 0.01% by weight to 0.5% by weight, of optical brighteners, in particular compounds from the class of substituted 4,4'-bis(2,4,6-triamino-s-triazinyl)stilbene-2,2'-disulfonic acids, up to 5% by weight, in particular from 0.1% by weight to 2% by weight, of complexing agents for heavy metals, in particular aminoalkylenephosphonic acids and salts thereof, up to 3% by weight, in particular from 0.5% by weight to 2% by weight, of antiredeposition agents and up to 2% by weight, in particular from 0.1% by weight to 1% by weight, of foam inhibitors, said parts by weight referring in each case to the total product.

Solvents which are used in particular in the case of novel liquid products are, as well as water, preferably those which are water-miscible. These include the low molecular weight alcohols, for example ethanol, propanol, iso-propanol, and the isomeric butanols, glycerol, low molecular weight glycols, for example ethylene glycol and propylene glycol, and the ethers which are derived from said classes of compounds. In such liquid products, the soil-release polyesters are usually present in dissolved or suspended form.

Enzymes which are optionally present are preferably chosen from the group consisting of protease, amylase, lipase, cellulase, hemicellulase, oxidase, peroxidase or mixtures thereof. The most suitable is protease obtained from microorganisms, such as bacteria or fungi. It can be obtained in a known manner by fermentation processes from suitable organisms, which are described, for example, in German Specifications DE-A-19 40 488, DE-A-20 44 161, DE-A-22 01 803 and DE-A-21 21 397, U.S. Patent Specifications U.S. Pat. Nos. 3,632,957 and 4,264,738, European Patent Application EP 006 638 and International Patent Application WO 91/02792. Proteases are available commercially, for example under the names BLAP®, Savinase®, Esperase®, Maxatase®, Optimase®, Alcalase®, Durazym® or Maxapem®. The lipase which may be used can be obtained from Humicola lanuginosa, as described, for example, in European Patent Applications EP 258 068, EP 305 216 and EP 341 947, from Bacillus types, as described, for example, in the International Patent Application WO 91/16422 or European Patent Application EP 384 717, from Pseudomonas types, as described, for example, in European Patent Applications EP 468 102, EP 385 401, EP 375 102, EP 334 462, EP 331 376, EP 330 641, EP 214 761, EP 218 272 or EP 204 284 or International Patent Application WO 90/10695, from Fusarium types, as described, for example, in European Patent Application EP 130 064, from Rhizopus types, as described, for example, in European Patent Application EP 117 553, or from Aspergillus types, as described, for example, in European Patent Application EP 167 309. Suitable lipases are available commercially, for example under the names Lipolase®, Lipozym®, Lipomax®, Amano®-Lipase, Toyo-jozo®-Lipase, Meito®-Lipase and Diosynth®-Lipase. Suitable amylases are commercially available, for example under the names Maxamyl® and Termamyl®. The cellulase which may be used can be an enzyme obtainable from bacereia or fungi which has a pH maximum preferably in the weakly acidic to weakly alkaline range from 6 to 9.5. Such cellulases are known, for example, from German Specifications DE-A-31 17 250, DE-A-32 07 825, DE-A-32 07 847, DE-A-33 22 950 or European Patent Applications EP 265 832, EP 269 977, EP 270 974, EP 273 125 and EP 339 550.

The customary enzyme stabilizers which may be present, particularly in novel liquid products include aminoalcohols, for example mono-, di-, triethanolamine and -propanolamine and mixtures thereof, low molecular weight carboxylic acids, as are known, for example, from European Patent Applications EP 376 705 and EP 378 261, boric acid or alkali metal borates, boric acid-carboxylic acid combinations, as known, for example, from European Patent Application EP 451 921, boric esters, as known, for example, from International Patent Application WO 93/11215 or European Patent Application EP 511 456, boronic acid derivatives;, as known, for example, from European Patent Application EP 583 536, calcium salts, for example the Ca-formic acid combination known from European Patent EP 28 865, magnesium salts, as known, for example, from European Patent Application EP 378 262, and/or sulfur-containing reducing agents, as known, for example, from European Patent Applications EP 080 748 or EP 080 223.

Suitable foam inhibitors include long-chain soaps, in particular behenic soap, fatty acid amides, paraffins, waxes, microcrystalline waxes, organopolysiloxanes and mixtures thereof, which may also comprise microfine, optionally silanized or otherwise hydrophobicized silica. For use in particulate products. such foam inhibitors are preferably bonded to granular, water-soluble carrier substances, as described, for example, in German Specification DE-A-34 36 194, European Patent Applications EP 262 588, EP 301 414, EP 309 931 or European Patent EP 150 386.

A novel product may also comprise antiredeposition agents. Antiredeposition agents have the task of keeping the dirt detached from the fiber suspended in the liquor and thus preventing graying of the fibers. For this purpose, water-soluble colloids of a mostly organic nature are suitable, for example the water-soluble salts of polymeric carboxylic acids, glue, gelatin, salts of ether carboxylic acids or ether sulfonic acids of starch or of cellulose or salts of acidic sulfuric acid esters of cellulose or of starch. Water-soluble polyamides containing acidic groups are also suitable for this purpose. Soluble starch preparations and starch products other than those given above can be used, for example a partially hydrolyzed starch. Sodium carboxymethylcellulose, methylhydroxyethylcellulose and mixtures thereof are preferably used.

Another embodiment of a novel product comprises bleaches based on peroxygen, in particular in amounts in the range from 5% by weight to 70% by weight, and optionally bleach activators, in particular in amounts in the range from 2% by weight to 10% by weight. Suitable bleaches are the percompounds normally used in detergents, such as hydrogen peroxide, perborate, which may be in the form of tetra- or monohydrate, percarbonate, perpyrophosphate and persilicate, which are normally in the form of alkali metal salts, in particular as sodium salts. Such bleaches are present in detergents which comprise a novel active ingredient combination preferably in amounts up to 25% by weight, in particular up to 15% by weight and particularly preferably from 5% by weight to 15% by weight, in each case based on the total product. The component of the bleach activators which may be present includes the customarily used N- or O-acyl compounds, for example polyacylated alkylenediamines, in particular tetraacetylethylenediamine, acylated glycolurils, in particular tetraacetylglycoluril, N-acylated hydantoins, hydrazides, triazoles, urazoles, diketopiperazines, sulfuryl amides and cyanurates, and carboxylic anhydrides, in particular phthalic anhydride, carboxylic acid esters, in particular sodium isononanoylphenolsulfonate, and acylated sugar derivatives, in particular pentaacetylglucose. In order to avoid interaction with the percompounds during storage, the bleach activators may be coated with coating substances in a known manner or be granulated, the use of carboxymethylcellulose to produce granulated tetraacetylethylenediamine having mean particle sizes of from 0.01 mm to 0.8 mm, as can be produced, for example, by the process described in European Patent EP 37 026, and/or granulated 1,5diacetyl-2,4dioxohexahydro-1,3,5-triazine, as can be prepared according to the process described in German Patent DD 255 884 being particularly preferred. In detergents, such bleach activators are preferably present in amounts up to 8% by weight, in particular from 2% by weight to 6% by weight, in each case based on the total product.

In a preferred embodiment, the novel product is in the form of powder and, in addition to the novel active ingredient combination, comprises from 20% by weight to 55% by weight of inorganic builders, up to 15% by weight, in particular from 2% by weight to 12% by weight, of water-soluble organic builders, from 2.5% by weight to 20% by weight of synthetic anionic surfactant, from 0.5% by weight to 20% by weight of nonionic surfactant, up to 25% by weight, in particular from 1% by weight to 15% by weight of bleach, up to 8% by weight, in particular from 0.5% by weight to 6% by weight, of bleach activator and up to 20% by weight, in particular from 0.1% by weight to 15% by weight, of inorganic salts, in particular alkali metal carbonate and/or sulfate.

In a further preferred embodiment, such a pulverulent product comprises, particularly for use as light-duty detergents, from 20% by weight to 55% by weight of inorganic builders, up to 15% by weight, in particular from 2% by weight to 12% by weight, of water-soluble organic builders, from 4% by weight to 24% by weight of nonionic surfactant, up to 15% by weight, in particular from 1% by weight to 10% by weight, of synthetic anionic surfactant, up to 65% by weight, in particular from 1% by weight to 30% by weight, of inorganic salts, in particular alkali metal carbonate and/or sulfate, and neither bleach nor bleach activator.

A further preferred embodiment comprises a liquid product comprising from 5% by weight to 35% by weight of water-soluble organic builders, up to 15% by weight, in particular from 0.1% by weight to 5% by weight, of water-insoluble inorganic builders, up to 15% by weight, in particular from 0.5% by weight to 10% by weight, of synthetic anionic surfactant, from 1% by weight to 25% by weight of nonionic surfactant, up to 15% by weight, in particular from 4% by weight to 12% by weight, of soap and up to 30% by weight, in particular from 1% by weight to 25% by weight, of water and/or water-miscible solvent.

EXAMPLES

Example 1

The soil release effect of the novel surfactant-soil release polymer (SRP) combinations compared with combinations of linear alkylbenzenesulfonate and alkylsulfate with SRP was investigated.

For this purpose, aqueous solutions of 1.0 g/l or 0.5 g/l of the respective surfactants and 0.06 g/l of a soil release polymer were prepared, and polyester WFK 30 A test fabrics (Krefeld Laundry Research Institute) were prewashed with these solutions. The fabrics treated in this way were dried and soiled with spent engine oil. After a contact time of 1 hour, the test cloths were washed with the same surfactant/soil release polymer solutions.

The reflectances of the test fabrics were then measured.

As a comparison, the test fabrics were washed with the surfactant solutions without a soil release polymer and with the soil release polymer without a surfactant and the reflectances were determined.

All concentrations refer to the respective active ingredient.

Soil Release Polymer I (SRP I)

Soil release polymer, prepared as described below, used in the amount stated in each case in the table.

Soil Release Polymer II (SRP II)

Soil release polymer ®Repel-O-Tex SRP 4, Rhône-Poulenc, used in the amount stated in each case in the table.

Preparation Procedure for Soil Release Polymer I (SRPI)

194.2 g of dimethyl terephthalate, 39.8 g of ethylene glycol, 90.6 g of 1,2-propylene glycol, 0.37 g of anhydrous sodium acetate and 0.19 g of titanium tetraisopropylate are rendered inert using nitrogen and heated to 165–167° C. over the course of half an hour in a 1 l four-necked flask fitted with precision stirrer, 20 cm Vigreux column with Claisen bridge, internal thermometer and gas inlet pipe. Over the course of a further 2.5 hours, the temperature is increased to 215–220° C. At an internal temperature of about 165° C., the transesterification reaction starts and with it distillation of methanol. After about 5 hours, >98% of the amount of methanol which is to be expected has distilled off. The mixture is cooled to about 80° C., and then 72.0 g of methylpolyethylene glycol 750, 91.2 g of methylpolyethylene glycol 1820 and 387.5 g of polyethylene glycol 1500 are added. The flask is again rendered inert and heated to 200–220° C., the pressure is then lowered to 5 mbar over the course of about 1 hour and condensation is continued for a further 2 to 5 hours at 220–240° C., during which a mixture of ethylene glycol and 1,2-propylene glycol distills off. When condensation is complete, the system is ventilated with nitrogen and cooled. Upon cooling to room temperature, the product solidifies to a solid mass. Yield 730 g.

TABLE 1

| Washing conditions | |
|---|---|
| Washing machine: | Linitest |
| Water hardness: | 20° German hardness |
| Liquor ratio: | 40:1 |
| Wash temperature: | 40° C. |
| Wash time: | 30 min. |
| Soil release polymer conc.: | 0.06 g/l |
| Surfactant concentrations: | 0.5 and 1.0 g/l |

TABLE 2

Washing results using the novel surfactant/soil release polymer combinations: 500 ppm surfactant/60 ppm SRP I

| | Reflectances (%) | | |
|---|---|---|---|
| Surfactant | 500 ppm of surfactant without SRP I | 60 ppm of SRP I without surfactant | 500 ppm of surfactant plus 60 ppm of SRP I |
| Marlon A 350 | 15.7 | 29.1 | 19.9 |
| Sulfopon 1218 G-F | 17.1 | 27.7 | 30.7 |
| Hostapur SAS 30 | 16.8 | 27.4 | 35.1 |

TABLE 3

Washing results with the novel surfactant/soil release polymer combinations: 1000 ppm of surfactant/60 ppm of SRP I

| | Reflectances (%) | | |
|---|---|---|---|
| Surfactant | 1000 ppm of surfactant without SRP I | 60 ppm of SRP I without surfactant | 1000 ppm of surfactant plus 60 ppm of SRP I |
| Marlon A 350 | 17.5 | 29.13 | 18.3 |
| Sulfopon 1218 G-F | 17.4 | 27.7 | 30.6 |
| Hostapur SAS 30 | 17.7 | 27.4 | 35.4 |
| Hostapur OS liquid | 20.9 | 28.3 | 34.9 |

TABLE 4

Washing results using the novel surfactant/soil release polymer combinations: 1000 ppm of surfactant/60 ppm of SRP II

| | Reflectances (%) | | |
|---|---|---|---|
| Surfactant | 1000 ppm of surfactant without SRP II | 60 ppm of SRP II without surfactant | 1000 ppm of surfactant plus 60 ppm of SRP II |
| Marlon A 350 | 17.5 | 25.6 | 20.7 |
| Sulfopon 1218 G-F | 17.4 | 25.6 | 26.6 |
| Hostapur SAS 30 | 17.7 | 25.6 | 28.8 |
| Hostapur OS liquid | 20.9 | 25.6 | 30.7 |

Example 2

The soil release polymer I as in Example 1 was incorporated into a liquid detergent formulation which comprised, as anionic surfactant, Hostapur SAS 60 or Hostapur OS liquid and, as comparison, Marlon A 350. Polyester fabric WFK 30 A was prewashed with the detergents for comparison purposes, dried, soiled with old engine oil and, after a contact time of one hour, washed with the same detergents as in the prewash.

The detergent concentration was 6 g/l.

Soil removal was then determined from the reflectance measurement. For comparison purposes, the washing tests were carried out without the addition of the soil release polymer.

The washing conditions were the same as those in Example 1.

TABLE 5

Composition of the liquid detergents in % by weight.

| Liquid detergent | Formulation I | Formulation II | Formulation III |
|---|---|---|---|
| Marlon A 350 | 20.4 | | |
| Hostapur SAS 60 | | 17.0 | |
| Hostapur OS liquid | | | 24.2 |
| Genapol OA 080 | 6.0 | 6.0 | 6.0 |
| Coconut/olein fatty acid mixture | 14.0 | 14.0 | 14.0 |
| KOH, 85% | 2.6 | 2.6 | 2.6 |
| Triethanolamine | 2.0 | 2.0 | 2.0 |
| Trisodium citrate dihydrate | 5.0 | 5.0 | 5.0 |
| Dequest 2066 | 4.0 | 4.0 | 4.0 |
| 1,2-Propylene glycol | 5.0 | 5.0 | 5.0 |
| Ethanol | 3.0 | 3.0 | 3.0 |
| Soil release polymer | 1.0 | 1.0 | 1.0 |
| Water | ad 100 | ad 100 | ad 100 |

TABLE 6

Washing results using formulations I, II and III

| | Reflectances (%) |
|---|---|
| Formulation I without SRP | 22.7 |
| Formulation I with SRP | 32.4 |
| Formulation II without SRP | 21.8 |
| Formulation II with SRP | 37.4 |
| Formulation III without SRP | 24.1 |
| Formulation III with SRP | 38.6 |

Example 3

The soil release polymer I as in Example I was incorporated into a washing powder which comprised, as anionic surfactant, Hostapur SAS 60 and, as a comparison, Marion A 350.

Washing tests were then carried out with these on polyester fabric WFK 30A, as described in Example 2.

The washing powder concentration was 6 g/l.

For comparison purposes, the washing tests were also carried out without the addition of this soil release polymer.

TABLE 7

Composition of the washing powder in % by weight

| Washing powder | Formulation I | Formulation II |
|---|---|---|
| Marlon A 350 | 9.6 | |
| Hostapur SAS 60 | | 8.0 |
| Genapol LA 070 | 5.1 | 5.1 |
| Soap | 3.6 | 3.6 |
| Zeolite A | 32.1 | 32.1 |
| SKS-6 | 3.4 | 3.4 |
| Soda | 11.7 | 11.7 |
| Sodium sulfate | 23.4 | 23.4 |
| Sodium salt of an acrylic acid-maleic acid copolymer | 5.1 | 5.1 |
| Carboxymethylcellulose | 1.3 | 1.3 |

TABLE 7-continued

Composition of the washing powder in % by weight

| Washing powder | Formulation I | Formulation II |
|---|---|---|
| EDTA | 0.2 | 0.2 |
| Water, foam inhibitor | ad 100 | ad 100 |
| Enzymes (protease, amylase) | 0.9 | 0.9 |
| Soil release polymer | 1.0 | 1.0 |

TABLE 8

Washing results using washing powders I and II

| Washing powder | Reflectance (%) |
|---|---|
| Formulation I without SRP | 26.4 |
| Formulation I with SRP | 31.2 |
| Formulation II without SRP | 26.5 |
| Formulation II with SRP | 36.2 |

Example 4

The soil release polymer I (SRP I) as in Example 1 was incorporated into a second washing powder which comprises, as anionic surfactant, Hostapur SAS 93-G and, as comparison, Marlon ARL.

Washing tests were then carried out with this on polyester fabric WFK 30 A, as described in Example 2.

The washing powder concentration was 6 g/l.

For comparision purposes, the washing tests were also carried out without the addition of this soil release polymer.

TABLE 9

Composition of the washing powder in % by weight

| Washing powder | Formulation III | Formulation IV |
|---|---|---|
| Marlon ARL | 10 | |
| Hostapur SAS 93-G | | 8.6 |
| Genapol OA 040 | 4 | 4 |
| Genapol OA 080 | 4 | 4 |
| Sodium carbonate | 11 | 11 |
| Sodium sulfate | 7 | 8.4 |
| Zeolite A | 24 | 24 |
| Citric acid | 5 | 5 |
| Sokalan CP 5 | 6 | 6 |
| Percarbonate | 20 | 20 |
| TAED | 5 | 5 |
| Foam inhibitor | 1 | 1 |
| Enzymes (protease, amylase) | 2 | 2 |
| Soil release polymer I | 1 | 1 |

TABLE 10

Washing results using washing powders III and IV

| Washing powder | Reflectance (%) |
|---|---|
| Formulation III without SRP | 27.2 |
| Formulation III with SRP | 35.1 |
| Formulation IV without SRP | 27.2 |
| Formulation IV with SRP | 41.8 |

List of trade names used

Marlon® A 350 linear $C_{10}$–$C_{12}$-alkylbenzenesulfonate, Hüls AG Na salt, 50%

Sulfopon® 1218 G-F $C_{12}$–$C_{18}$-fatty alcohol sulfate, 90%

Henkel KGaA
Hostapur® SAS 30/secondary $C_{13}$–$C_{17}$-
Clariant GmbH n-alkanesulfonate, sodium salt, 30%
Hostapur® SAS 60 . . . n-alkanesulfonate, sodium salt, 60%
Hostapur® OS liquid $C_{14}$–$C_{16}$-alpha-olefinsulfonate, sodium
Clariant GmbH salt, 42%
Repel-O-Tex® SRP 4/ethylene glycol-polyethylene glycol-
Rhône-Poulenc terephthalic acid copolymer up to 70%, remainder sodium sulfate and sodium aluminum silicate
Genapol® OA 040 $C_{14}$–$C_{15}$-oxo alcohol oxethylate with
Clariant GmbH 3 EO
Genapol® OA 080 $C_{14}$–$C_{15}$-oxo alcohol ethoxylate with 8EO,
Clariant GmbH 100%
Dequest® 2066 25% strength aqueous solution of the
Monsanto heptasodium salt of diethylenetriamine-penta (methylenephosphonic acid)
Genapol® LA070/$C_{12/14}$-fatty alcohol ethoxylate with 7EO,
Clariant GmbH 100%
SKS-6/Clariant GmbH cryst. sodium phyllosilicate
Marlon® ARL linear $C_{10}$–$C_{12}$-alkylbenzenesulfonate, Hüls AG Na salt, 80%
Hostapur® SAS 93 G sec. $C_{13}$–$C_7$-n-alkanesulfonate, sodium
Clariant GmbH salt, 93%
TAED tetraacetylethylenediamine
Sokalan® CP5 Na salt of an acrylic acid-maleic acid
BASF copolymer

What is claimed is:

1. A detergent and cleaner comprising an active ingredient combination consisting of a soil-release polymer and alkanesulfonate and/or α-olefinsulfonate, said soil release polymer being terminally capped with $C_1$–$C_{22}$-alkyl groups or ester groups of $C_5$–$C_{32}$-monocarboxylic acids.

2. The detergent and cleaner as claimed in claim 1, wherein the weight ratio of soil-release polymer to the total amount of sec-alkanesulfonate and/or α-olefinsulfonate is from 1:25 to 1:2.

3. The detergent an cleaner as claimed in claim 1, comprising from 5 to 50% by weight of the active ingredient combination.

4. A detergent and cleaner comprising an active ingredient combination consisting of a soil release polymer being terminally capped with $C_1$–$C_{22}$-alkyl groups or ester groups of $C_5$–$C_{32}$-monocarboxylic acids and a sec-alkanesulfonate.

* * * * *